United States Patent [19]

Erana

[11] Patent Number: 4,807,690

[45] Date of Patent: Feb. 28, 1989

[54] SHOOTING DEVICE FOR CORE BLOWING MACHINES

[76] Inventor: Agustin A. Erana, Zorrostea, 4 Polígono Industrial Ali-Bobeo, 01010 Vitoria Alava, Spain

[21] Appl. No.: 79,034

[22] Filed: Jul. 29, 1987

[30] Foreign Application Priority Data

Aug. 12, 1986 [ES] Spain ..... 8600285

[51] Int. Cl.[4] ..... B22C 15/22

[52] U.S. Cl. ..... 164/200; 164/198

[58] Field of Search ..... 164/37, 169, 198, 200, 164/201, 202

[56] References Cited

U.S. PATENT DOCUMENTS 2,882,565 4/1959 Selby ..... 164/201

3,659,642 5/1972 Vasilkovsky et al. ..... 164/37

FOREIGN PATENT DOCUMENTS 425719 10/1974 U.S.S.R. ..... 164/169

804183 2/1981 U.S.S.R. ..... 164/169

*Primary Examiner*—Nicholas P. Godici

*Assistant Examiner*—Richard K. Seidel

*Attorney, Agent, or Firm*—Helfgott & Karas

[57] ABSTRACT

Shooting device for core blowing machines, which may be coupled to the mouth of the sand magazine prior to the shooting operation and separated therefrom at the end of said shooting operation in order to change the magazine. The device includes a ram, alternatively displaceable by hydraulic means, designed to couple to and separate from the mouth of the magazine, through which the air discharged from the reservoir reaches the magazine with the aid of a shooting valve which cuts off the supply from the reservoir by means of the pressure source acting against the piston and specifically against one of the surfaces of the piston having a considerably larger surface area than that against which acts the pressure from the reservoir, aperture whereof is effected automatically by cutting off the pressure source supply both to the valve itself and to the reservoir. The shooting valve is established within the hollow ram and the fluid stored in the reservoir reaches the magazine through the ram itself and, with the shooting valve placed therebetween, through the actual guide columns for alternative displacement of the ram, wherefore the columns are hollow.

4 Claims, 2 Drawing Sheets

SHOOTING DEVICE FOR CORE BLOWING MACHINES

OBJECT OF THE INVENTION

The present invention, in accordance with the title of the specification, relates to a shooting device for core blowing machines, whereby the sand contained in the corresponding magazine may be automatically driven towards the moulding boxes. More specifically, the said mechanism is designed to supply the air pressure required at a certain moment for emptying the magazine at a practically constant flow, i.e., with no appreciable decrease in pressure during the complete emptying cycle of the magazine, for which purpose the fluid stored in a small reservoir is used.

BACKGROUND OF THE INVENTION

The applicant hereof is the holder of patent of invention No. 546.612, likewise describing a shooting mechanism of core blowing machines with the above mentioned objective, and comprised by a hollow ram open at the perimetral area of its lower base in correspondence with the mouth of the magazine and having annular sealing joints to ensure airtight coupling between the ram and the magazine, the said ram extending axially upwards into a hollow body constituting the supply duct of the ram and within which is telescopically established a second and likewise hollow body emerging at the upper end of the former and receiving a shooting valve acting as a control element for passage along the two bodies from an upper reservoir.

Given that the magazine must obviously be changed after each shooting operation, the shooting mechanism must be capable of extending and retracting telescopically in order to be either sealingly coupled to the mouth of the magazine prior to shooting, or separated therefrom after shooting for changing the said magazine.

This solution, though perfectly valid as regards its functional philosophy, and likewise valid in practice from an operative point of view, has as an essential disadvantage the fact that it has a greatly complex structure, which may be simplified considerably, and a volume which has likewise been substantially reduced in this invention.

DESCRIPTION OF THE INVENTION

The shooting mechanism being described, whilst maintaining the same functional philosophy as previously mentioned patent of invention No. 546.612, and thus including the hollow ram open at its lower base for coupling to the magazine and being projectable thereagainst and retractable through the effect of a hydraulic cylinder, and likewise including a shooting valve and an auxiliary rapid-discharge valve, centres its basic characteristics on the fact that the columns or lateral guides conventionally designed as a means for preventing pitching of the mobile elements of the shooting mechanism, are used as ducts for supplying the air from the reservoir.

More specifically, and in this regard, the guide bushings integral with the frame of the machine, wherein the columns are displaced, extend into tubular ducts leading up to the reservoir, whereas the actual columns are hollow and play within the said guide bushings with the aid of sealing joints, preferably of the double-joint type, which ensure airtight sealing between the mobile and stationary parts.

The said columns open directly into the hollow interior of the ram to which they are likewise sealingly coupled, the shooting valve being established within the said ram and having a structure similar to that of patent of invention No. 546.612, the body of the said shooting valve being integral with the upper base of the ram, whereas the piston or plunger thereof rests on a seat operatively made on an intermediate annular partition provided in said ram, below which, and in correspondence with the lower base of the ram, there is established an aperture for passage of air to the magazine, aided by the respective filter, an auxiliary rapiddischarge valve being furthermore established in this lower chamber of the ram, i.e., under the shooting valve.

It can be deduced from the structure described that the shooting mechanism affords, on the one hand, a considerable structural simplification, being restricted practically to the ram, the shooting valve established therein, and the corresponding vertical guides for displacement thereof with respect to the frame of the machine, the said structure further allowing the use, as displacement means for the ram, of a conventional hydraulic cylinder, available on the market, and installed directly on the frame of the machine, with its piston rod coupled to the ram, as opposed to the structure of patent of invention No. 546.612 wherein a special structure is required for this mechanism between the shooting valve and the ram on the basis of several cylindrical and coaxial bodies for establishing chambers of alternate connection to the pressure source. On the other hand, the solution herein provides two ducts for the passage of air from the reservoir to the magazine, namely the two guides for vertical displacement of the ram, as opposed to the single duct of patent of invention No. 546.612, which implies a greater air flow and therefore a more rapid discharge of fluid and more efficient shooting operation, all of which is achieved at a considerably lower cost deriving from the substantial simplification of the structure involved.

DESCRIPTION OF THE DRAWINGS

In order to complete the description being made, and to assist the better understanding of the characteristics of the invention, a set of drawings is attached to the present specification, as an integral part thereof, where the following has been shown in an illustrative and non limiting manner.

PREFERRED EMBODIMENT OF THE INVENTION

Figure 1:
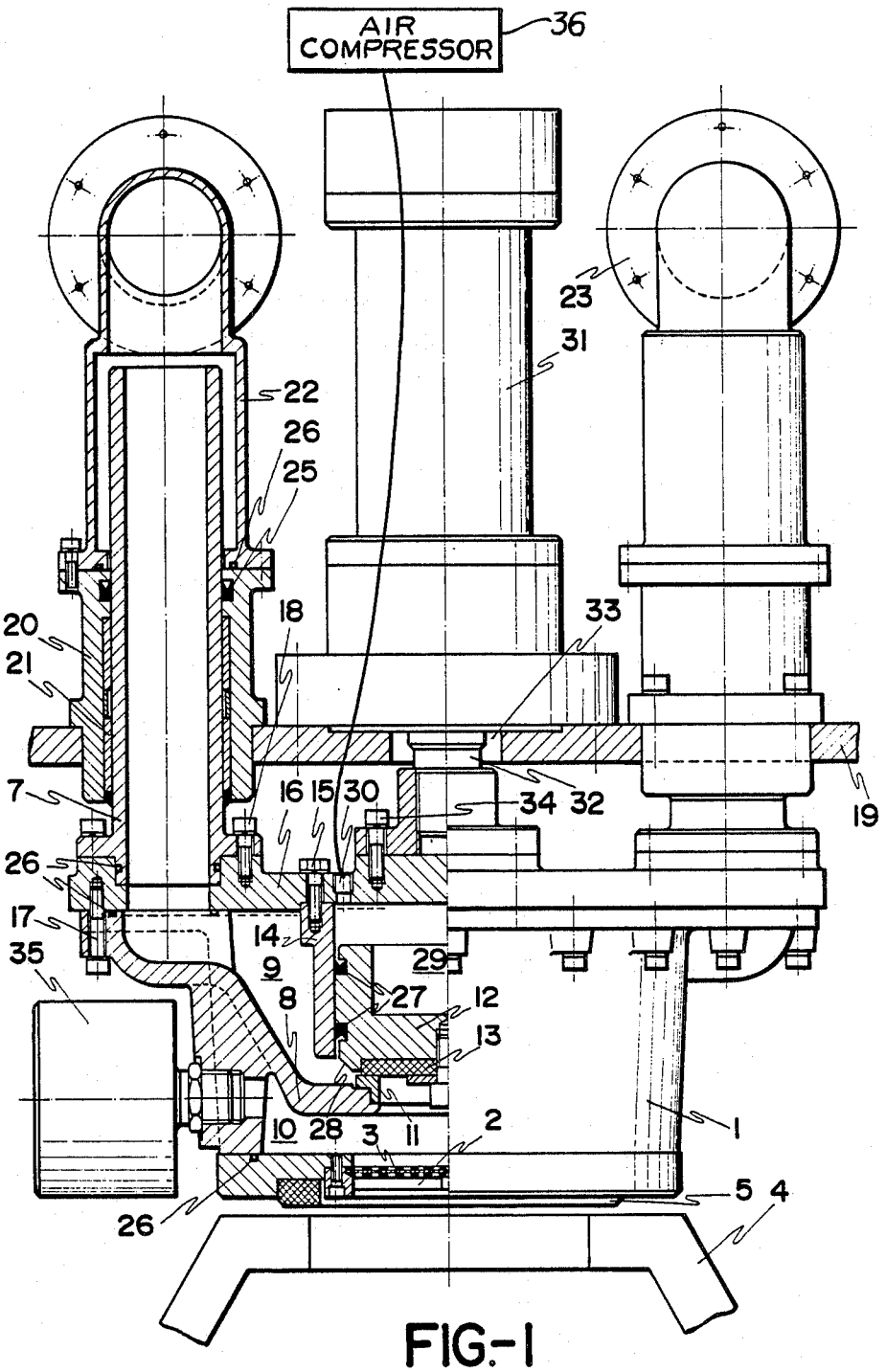
FIG. 1 is a front elevational view and quarter section of a shooting mechanism for core blowing machines in accordance with the object of the present invention.
Figure 2:
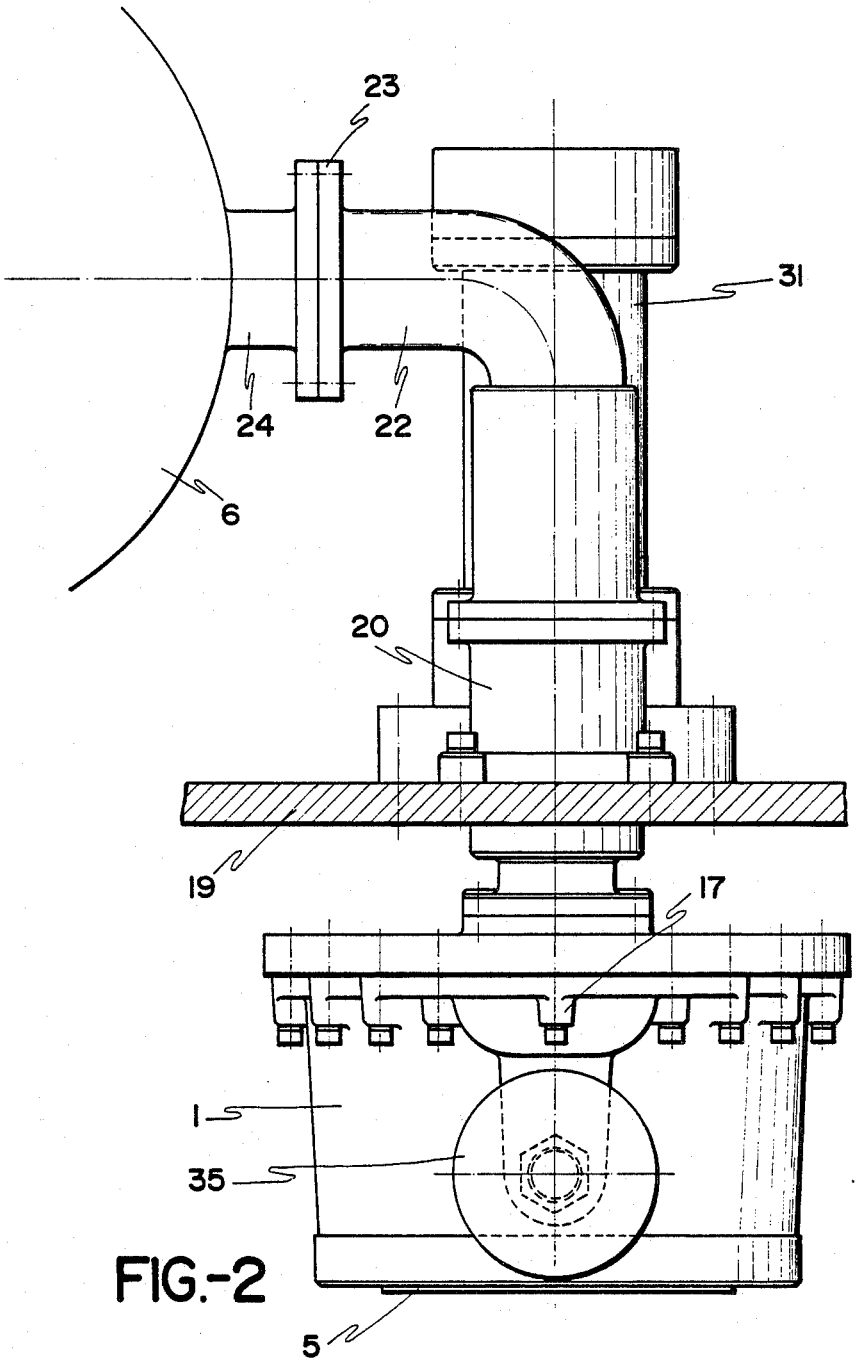
FIG. 2 is a side elevational view of the assembly of the preceding figure, partially showing the reservoir which supplies pressure for the shooting operation and the section of the frame of the blowing machine whereon the mechanism is installed.

In the light of the preceding figures, it can be seen that the shooting mechanism being described includes, as does patent of invention No. 546.612, a ram 1 with an aperture 2 at its lower base for discharging the air, with aid of filter 3, towards magazine 4, to which it is sealingly coupled with the aid of sealing joint 5, but having the special particularity that said ram is hollow, as shown clearly in FIG. 1, the shooting valve is established therein and the air reaches said shooting valve from reservoir 6 through the columns 7 which ensure alternative displacement of the ram whilst preventing pitching thereof.

More specifically, ram 1 is comprised by a body of revolution, marked 1, provided with an internal wall 8 which defines two separate chambers 9 and 10 therein, a seat 11 for piston 12 of the shooting valve being established on the mouth of the aperture defined by said wall 8, together with corresponding joint 13, the said piston 12 being displaceable within the body of valve 14 which is comprised by a cylindrical bushing fastened by means of screws 15 to an upper cover 16 for closing the upper base of ram body 1, which cover 16 is fastened to body 1 by means of a perimetral alignment of screws 17. The mentioned guide-columns 7 are coupled to cover 16 by means of screws 18 at two diametrically opposed points, and cross frame 19 of the blowing machine with the aid of guide bushings 20 aided by corresponding friction bearings 21, the said columns 7 being hollow, as aforesaid, and the guide bushings 20 extending upwards into tubular ducts 22 the free ends whereof are fastened to corresponding outlets 24 of reservoir 6 with the aid of flanges 23, such that the said reservoir 6 and the upper chamber 9 of the ram body are permanently and directly in communication, with the collaboration of elements which are capable of allowing alternative displacement of the said ram with no damage to its sealed condition, wherefor a double joint 25 is established between each column 7 and its corresponding guide bushing 20 together with joints 26 for sealed coupling between the elements taking part in this structure.

With respect to piston 12 of the shooting valve, it is related to the corresponding body of the valve 14 by means of sealing rings 27, and the said valve body 14 is displaced substantially outwards with respect to valve seat 11 in order that a perimetral sector 21 may be defined in piston 12 for actuation thereon of the pressure from the reservoir in the direction of aperture for the valve, as will be described hereinafter.

Valve body 14, piston 12 and the upper cover 16 of the ram, define a further sealed chamber 29 wherein is established an inlet 30 with the respective duct for supplying the closing pressure to the shooting valve. Pressurized air is supplied to inlet 30 via a conventional source such as air compressor 36.

The up-and-down displacement of the ram is effected with the aid of a hydraulic cylinder 31, fitted directly to frame 19, the piston rod 32 whereof crosses said frame through aperture 33 in order to couple directly to the upper cover 16 of ram 1 with the aid of screws 34, and thus to the ram as a whole.

A radial outlet is established in lower chamber 10 of the ram for sealed coupling of the conventional rapid-discharge valve 35.

In accordance with the structure described, operation of the shooting mechanism is as follows:

Air under pressure from a suitable source 36 reaches shooting reservoir 6 and from there passes through hollow columns 7 to upper chamber 9 of ram 1, acting against the perimetral edge 28 of the piston and simultaneously reaching chamber 29 within the shooting valve through a duct being suitably coupled to aperture 30, wherefore, due to the fact that, with equal pressure, the inner face of piston 12 has a considerably larger surface area than its outer face, i.e., that the inner face of the piston is much larger than the outer face 28 on which acts an opposing pressure, the shooting valve remains closed. In this position, and once the pertinent magazine 4 has been installed, hydraulic cylinder 31 is actuated and the ram descends and couples sealingly thereto with the aid of joint 5, the previous situation with respect to pressures being maintained on the plug of the shooting valve. When pressure supply to the mechanism is cut off, the pressure no longer acts on the inner surface of piston 12, but the pressure on its outer perimetral section 28 remains due to reservoir 6, wherefore the piston 12 is retracted in a vertically ascending direction and produces instant discharge of the reservoir through the two hollow columns 7, upper chamber 9 of the ram, lower chamber 10 thereof, and lower outlet aperture 2, towards the magazine.

At the end of this operative cycle, and upon return of the piston 12 of the shooting valve to its closed position, rapid-discharge valve 35 opens and pressure in lower chamber 10 thus disappears, the said rapid-discharge valve may be aided by a silencer for dampening the noise produced during such rapid discharge.

It is not considered necessary to extend the present description any further for an expert in the art to understand the scope of the invention and the advantages derived therefrom.

The materials, shape, size and arrangement of the elements may vary, provided this does not imply a modification in the essentiality of the invention.

The terms used to describe the specification should be understood as having a wide and non limiting meaning.

Having described the object of the present invention, it is declared that the essential features thereof are contained in the following

I claim:

1. Shooting Device for Core Blowing Machines, which may be coupled to the mouth of the sand magazine prior to the shooting operation and separated therefrom at the end of said shooting operation in order to change the magazine, and which includes a ram, alternatively displaceable by hydraulic means, designed to couple to and separate from the mouth of the magazine, through which ram the air discharged from the reservoir reaches the magazine with the aid of a shooting valve which cuts off the supply from the reservoir by means of the pressure source acting against the piston thereof and specifically against one of the surfaces of said piston having a considerably larger surface area than that against which acts the pressure from the reservoir, aperture whereof is effected automatically by cutting off the pressure source supply both to the valve itself and to the reservoir, is essentially characterised in that the shooting valve is established within the hollow ram and the fluid stored in the reservoir reaches the magazine through the ram itself and, with the shooting valve placed therebetween, through the actual guide columns for alternative displacement of the ram, wherefore the said columns are hollow.

2. Shooting Device for Core Blowing Machines, in accordance with claim 1, characterised in that the hollow ram is comprised by a body, basically of revolution, complemented by respective upper and lower closing covers, and having an internal annular wall defining an axial aperture on the mouth whereof is established the corresponding seat for the shooting valve plug, the body of which valve is fastened to the upper cover of the ram, three chambers being thus established within the latter, a perimetral upper chamber in communication with the reservoir through the hollow guide columns, an internal upper chamber estblished between the shooting valve and the upper cover of the ram, and being in communication, through a suitable duct, with the pressure source which reaches said chamber through an aperture operatively made in the cover of the ram, and a third lower chamber established between the annular wall of the ram and the lower cover thereof, which is in communication with the magazine through a central aperture provided in the said cover and having the corresponding grid, and with the upper external chamber when the shooting valve is open, it having been further foreseen that the said lower chamber is provided with a radial aperture for the coupling thereto of a rapid-discharge valve.

3. Shooting Device For Core Blowing Machines, in accordance with claim 1, characterised in that the hollow guide columns assisting the ram in its alternative displacements play on respective bushings with bearings and sealing joints therebetween, it being further foreseen that said bushings sealingly engage upper tubular ducts for communication with the reservoir, such that communication between said reservoir and the ram remains airtight during alternative displacement of the latter.

4. Shooting Device for Core Blowing Machines, in accordance with claim 1, characterised in that the upper cover of the ram is stiffened to the piston rod or moving element of a hydraulic cylinder, the fixed body whereof is integral with the frame of the machine between the two guide columns of the ram.

* * * * *